US005459027A

United States Patent [19]

Takada et al.

[11] Patent Number: 5,459,027

[45] Date of Patent: * Oct. 17, 1995

[54] SILVER HALIDE PHOTOGRAPHIC LIGHT-SENSITIVE MATERIAL

[75] Inventors: Shunji Takada; Hiroyuki Mifune; Tetsuro Kojima, all of Minami-ashigara, Japan

[73] Assignee: Fuji Photo Film Co., Ltd., Kanagawa, Japan

[ * ] Notice: The portion of the term of this patent subsequent to Jun. 1, 2010 has been disclaimed.

[21] Appl. No.: 24,915

[22] Filed: Mar. 2, 1993

Related U.S. Application Data

[63] Continuation-in-part of Ser. No. 904,591, Jun. 26, 1992, abandoned.

[30] Foreign Application Priority Data

Jun. 28, 1991 [JP] Japan ..... 3-183487

[51] Int. Cl.[6] ..... G03C 1/09

[52] U.S. Cl. ..... 430/603; 430/604; 430/605

[58] Field of Search ..... 430/567, 603, 430/604, 605

[56] References Cited

U.S. PATENT DOCUMENTS

| | | | |
|---|---|---|---|
| 1,574,944 | 3/1926 | Sheppard | 430/603 |
| 1,602,591 | 10/1926 | Sheppard | 430/603 |
| 4,431,730 | 2/1984 | Urabe et al. | 430/603 |
| 4,914,016 | 4/1990 | Miyoshi et al. | 430/605 |
| 4,923,794 | 5/1990 | Sasaki et al. | 430/603 |
| 5,215,880 | 6/1993 | Kojima et al. | 430/603 |
| 5,273,872 | 12/1993 | Asami | 430/603 |
| 5,273,874 | 12/1993 | Kojima et al. | 430/603 |

FOREIGN PATENT DOCUMENTS

| | | |
|---|---|---|
| 800958 | 12/1968 | Canada . |
| 1295462 | 11/1972 | United Kingdom . |
| 1396696 | 6/1975 | United Kingdom . |

OTHER PUBLICATIONS

Research Disclosure 308119, Dec. 1989.

*Primary Examiner*—Janet C. Baxter
*Attorney, Agent, or Firm*—Birch, Stewart, Kolasch & Birch

[57] ABSTRACT

Disclosed herein is a silver halide photographic light-sensitive material comprising at least one layer made of a silver halide emulsion comprising a dispersion medium and silver halide grains dispersed in the dispersion medium. Each of the silver halide grains contains a metal or metal ions other than silver. The emulsion has been chemically sensitized in the presence of a tellurium compound which has a pseudo-first order reaction rate constant k of $1\times10^{-8}$ to $1\times10^{-0}$ min $^{-1}$. The metal is at least one polyvalent metal selected from the group consisting of Ir, Rh, Pd, Ru, Pt, Os, Fe, Ni and Co. The metal ions are ammonium salt, acetate, nitrate, sulfate, phosphate, hydroxide, or complex salt of the metal. Telluroketones or phosphinetellurides is used as the tellurium compound. It is desirable that the silver halide emulsion is a monodispersed emulsion having a variation coefficient of 22% or less. The silver halide photographic light-sensitive material has its photographic properties, particularly the gradation and the reciprocity, improved, with no reduction of its sensitivity.

15 Claims, No Drawings

SILVER HALIDE PHOTOGRAPHIC LIGHT-SENSITIVE MATERIAL

This application is a continuation-in-part of application Ser. No. 07/904,591 filed on Jun. 26, 1992, now abandoned.

BACKGROUND OF THE INVENTION

1. Field of the Invention

The present invention relates to a silver halide photographic light-sensitive material, and more particularly to a silver halide photographic light-sensitive material which excels in sensitivity, gradation, and reciprocity.

2. Description of the Related Art

In order to provide a silver halide photographic light-sensitive material which has sufficient property regarding to gradation and reciprocity, it has been generally practiced to use silver halide grains containing metal other than silver or ions of the metal. As is known in the art, however, the use of such silver halide grains reduces the sensitivity of the material.

Known as applicable sensitization are chalcogen sensitization, gold sensitization, and reduction sensitization. They can be used either singly or in combination. Known examples of chalcogens are sulfur, selenium, and tellurium. Sensitization using sulfur is the most commonly practiced sensitization, widely employed in preparing practical emulsions. Sensitization using selenium is less popular than sulfur sensitization, but various methods of performing selenium sensitization are disclosed a number of patent specifications. Tellurium is not put to practical use in sensitization, and tellurium sensitization is scarcely introduced in research literature. Tellurium sensitizers and the conditions for using them are specified in only a few references, such as British Patents 1,295,462 and 1,396,696, and Canadian Patent 800,958.

SUMMARY OF THE INVENTION

The object of this invention is to provide a silver halide photographic light-sensitive material which has its gradation and reciprocity, both being important photographic properties, improved without a reduction of its sensitivity.

The object has been attained by a silver halide photographic light-sensitive material which comprises at least one silver halide emulsion layer comprising a dispersion medium and silver halide grains dispersed in the dispersion medium, each of the silver halide grains containing a metal or metal ions other than silver, and said emulsion having been chemically sensitized in the presence of a tellurium compound which has a pseudo-first order reaction rate constant k of $1\times10^{-8}$ to $1\times10^{0}$ $min^{-1}$.

The object has also been achieved by a silver halide photographic light-sensitive material of the type described above, which contains polyvalent metal ions.

The object has also been accomplished by a silver halide photographic light-sensitive material of the type described above, wherein said tellurium compound is one represented by the following formula (I) or (II):

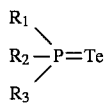

Formula (I)

where $R_1$, $R_2$ and $R_3$ are aliphatic groups, aromatic groups, heterocyclic groups, $OR_4$, $NR_5(R_6)$, $SR_7$, $OSiR_8(R_9)(R_{10})$, X or hydrogen atoms, $R_4$ and $R_7$ are aliphatic groups, aromatic groups, heterocyclic group, hydrogen atoms or cations, $R_5$ and $R_6$ are aliphatic groups, aromatic groups, heterocyclic groups or hydrogen atoms, $R_8$, $R_9$ and $R_{10}$ are aliphatic groups, and X is a halogen atom;

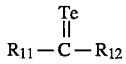

Formula (II)

where $R_{11}$ is aliphatic group, aromatic group, heterocyclic group or $—NR_{13}(R_{14})$, $R_{12}$ is $—NR_{15}(R_{16})$, $—N(R_{17})N(R_{18})R_{19}$ or $—OR_{20}$, $R_{13}$, $R_{14}$, $R_{15}$, $R_{16}$, $R_{17}$, $R_{18}$, $R_{19}$ and $R_{20}$ are hydrogen atoms, aliphatic groups, aromatic groups, heterocyclic groups or acyl groups, $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ each can be bound to each other, to form a ring.

Further, the object of the invention can be attained by a silver halide photographic light-sensitive material of the type described above, in which said silver halide emulsion is a monodispersed emulsion having a variation coefficient of 22% or less.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Embodiments of the present invention will now be described.

The metal other than silver, which is used in the invention can be contained in each silver halide grain, in the form of metal or metal ions. The metal can be introduced into the grain during the preparation of an emulsion, particularly while the grain is precipitating or being ripened by adding a salt of the metal ions. The metal can be doped in the whole grain, in only the core of the grain, in only the shell thereof, in only the near-surface region thereof, in only the epitaxial part thereof, or in only the base thereof.

Metals which can be contained in the silver halide grains are: Mg, Ca, St, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, Bi, and the like. These metals can be added in the form of any salt that can be dissolved during the forming of the grains, such as ammonium salt, acetate, nitrate, sulfate, phosphate, hydroxide, six-coordinate complex, or four-coordinate complex. Specific example of this salt are: $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$, and the like. The ligand of coordination compound can be selected from the group consisting of halo, aquo, cyano, cyanate, thiocyanate, nitrosyl, thionitrosyl, oxo, and carbonyl. Only one of these metal compounds is used, or two or three, or more of these can be used in combination.

It is desirable that the metal compound or compounds be dissolved in an appropriate solvent such as water, methanol or acetone, and the resultant solution be added to the emulsion. To stabilize the solution, aqueous solution of a hydrogen halide (e.g., HCl or HBr), or an alkali halide (e.g., KCl, NaCl, KBr, or NaBr) can be added to the solution.

Further, acid or alkali can be added to the solution, if necessary. The metal compounds can be supplied into the reaction vessel, either before or during the forming of the silver halide grains. Alternatively, the metal compounds can be added to aqueous solution of a water-soluble silver salt (e.g., $AgNO_3$) or an alkali halide (e.g., NaCl, KBr or KI), and the resultant solution can be continuously supplied into the reaction vessel during the forming of the silver halide grains. Also, a solution containing the metal compounds can be prepared as well as a water-soluble silver salt solution and an alkali halide solution, and continuously introduced into the reaction vessel during a proper part of the grain-forming period. It is also preferable that the metal compounds be added by a combination of various methods.

Polyvalent metal ions are the preferable metal as to be contained in the silver halide grain. These polyvalent ions substitute for the silver ions. Since silver ions are monovalent, the polyvalent metal ions provide vacancies in the silver halide, thereby reducing the number of interstitial silver ions existing in the silver halide. Many of the polyvalent metal ions can change its charge numbers, and can thus traps electrons or positive holes within each silver halide grain. In view of their function, the polyvalent metal ions can improve photographic properties such as gradation and reciprocity. Polyvalent metal ions are, therefore, very important in practice.

Of polyvalent metal ions, preferable are ions of metal belonging to platinum group (Group VIII) such as Ir, Rh, Pd, Ru, Pt and Os, and also ions of transition metals Group VIII, the 4th period such as Fe, Ni and Co.

The metal or the metal ions are contained in the silver halide grains, in an amount of $10^{-9}$ to $10^{-3}$ mol per mol of silver halide, preferably $10^{-8}$ to $10^{-4}$ mol per mol of silver halide, and more preferably $10^{-7}$ to $10^{-5}$ mol per mol of silver halide.

The tellurium sensitizers used in the tellurium sensitization of the present invention are tellurium compounds which form silver telluride in the surface or interior of a silver halide grain, which is considered to function as a sensitization nucleus.

The tellurium sensitizers used in the present invention have a pseudo-first order reaction rate constant k of $1\times10^{-8}$ to $1\times10^{0}$ $min^{-1}$ as described below.

The rate with which silver telluride is formed in the silver halide emulsion can be determined by the following test:

When a tellurium sensitizer is added in a great amount (e.g., $1\times10^{-3}$ mol/mol Ag), the silver telluride formed absorbs light beam of the visible region. Hence, the method applied for sulfur sensitizers disclosed in E. Moisar, "Journal of Photographic Science," Vol 14, page 181 (1966) and Ibit., Vol. 16, page 102 (1968) can be applied. Therefore, the relative rate at which silver telluride is formed can easily be obtained by the same method as used in determining the amount of silver sulfide formed in a silver halide emulsion from the infinite reflectivity of the emulsion to light beams of the visible region (520nm) in accordance with the Kubelka-Munk formula. Since this reaction is apparently similar to a first order reaction, a pseudo-first order reaction rate constant k can be obtained, too.

Next, it will be described how to obtain the pseudo-first order reaction rate constant k.

An emulsion which contains octahedral silver bromide grains having an average size of 0.5 μm (containing 0.75 mol of AgBr and 80 g of gelatin, per kilogram) is maintained at 50° C., while holding pH and pAG at 6.3 and 8.3, respectively. A tellurium compound dissolved in an organic solvent (e.g., methanol) is added to the emulsion, in an amount of $1\times10^{-3}$ mol/mol Ag. The resultant emulsion is filled in a cell having a thickness of 1 cm. Then, the reflectivity (R) change of the emulsion to light beams of 520 nm with the time is detected by means of a spectrophotometer having an integrating sphere, using the reflectivity of a blank emulsion as reference. Reflectivity, thus detected, is substituted in the Kubelka-Munk formula, $(1-R)^2/2R$. The time when the value of $(1-R)^2/2R$ becomes 0.01 is measured. The pseudo-first order reaction rate constant k ($min^{-1}$) is determined from the time thus measured. If no silver telluride is formed at all, R=1, and the Kubelka-Munk value is 0 as in the case where no telluride is present. Preferable is a tellurium compound which is found to have an apparent pseudo-first order reaction constant k of $1\times10^{-8}$ to $1\times10^{0}$ $min^{-1}$ when tested in exactly the same way as described above.

The pseudo-first order reaction rate constant k of the tellurium sensitizers of the present invention, which have been obtained by performing the test described above, are as follows, for example:

Compound 7 ca. $4\times10^{-3}$ $min^{-1}$

Compound 10 ca. $2\times10^{-3}$ $min^{-1}$

Compound 12 ca. $8\times10^{-4}$ $min^{-1}$

Compound 18 ca. $2\times10^{-4}$ $min^{-1}$

Compound 4 ca. $7\times10^{-5}$ $min^{-1}$

Note that these compounds are exemplified tellurium sensitizers, which will be presented later.

In the case where a tellurium sensitizer is added in so small an amount that the absorption of light beam of the visible region can hardly be detected, the silver telluride formed is separated from the unreacted tellurium sensitizer, to determine the quantity of the silver telluride. For instance, the silver telluride formed can be separated by immersion in an aqueous solution of a halogen salt or a water-soluble mercapto compound, and then a small amount of Te can be quantitatively analyzed by means of atomic absorption spectrometry. The reaction rate varies by several orders, depending on not only the type of the tellurium compound, but also the silver halide composition of the emulsion tested, the test temperature, the values of pAg and pH, and the like. The tellurium sensitizers preferred for use in the present invention are tellurium compounds which can form silver telluride when reacted with a silver halide emulsion which has the same halide composition and crystal habit as those of the emulsion to be used. The tellurium sensitizer preferably used in the present invention can react with a silver halide emulsion at 40° to 95° C., at pH value of 3 to 10, or at a pAg value of 6 to 11. More preferable tellurium sensitizers have a pseudo-first order reaction rate constant k of $1\times10^{-7}$ to $1\times10^{-1}$ $min^{-1}$ when tested by the method specified above at 40° to 95° C., at pH value of 3 to 10, or at a PAg value of 6 to 11.

Of the tellurium compounds specified above, those represented by the following formula (I) or (II) are suitable for use in this invention:

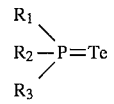

Formula (I)

where $R_1$, $R_2$ and $R_3$ are aliphatic groups, aromatic groups, heterocyclic groups, $OR_4$, $NR_5(R_6)$, $SR_7$, $OSiR_8(R_9)(R_{10})$, X or hydrogen atoms, $R_4$ and $R_7$ are aliphatic groups, aromatic groups, heterocyclic group, hydrogen atoms or cations, $R_5$ and $R_6$ are aliphatic groups, aromatic groups, heterocyclic groups or hydrogen atoms, $R_8$, $R_9$ and $R_{10}$ are aliphatic groups, and X is a halogen atom;

$$R_{11}-\overset{\overset{\text{Te}}{\|}}{C}-R_{12} \qquad \text{Formula (II)}$$

where $R_{11}$ is an aliphatic group, an aromatic group, a heterocyclic group or $-NR_{13}(R_{14})$, $R_{12}$ is $-NR_{15}(R_{16})$, $-N(R_{17})N(R_{18})R_{19}$ or $-OR_{20}$, $R_{13}$, $R_{14}$, $R_{15}$, $R_{16}$, $R_{17}$, $R_{18}$, $R_{19}$ and $R_{20}$ are hydrogen atoms, aliphatic groups, aromatic groups, heterocyclic groups or acyl groups, $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, and $R_{13}$ and $R_{20}$ each can be bound to each other, to form a ring.

Tellurium compounds can be dissolved in an appropriate solvent such as methanol or acetone, and the resultant solution can be added to the emulsion. In the invention, a tellurium compound or tellurium compounds are added to the emulsion, in an amount of $10^{-9}$ to $10^{-3}$ mol per mol of silver halide, preferably $10^{-8}$ to $10^{-4}$ mol per mol of silver halide. The compound or compounds can be added at various timings, so as to prepare various types of emulsions. Among these types of emulsions are: an emulsion containing grains each having tellurium sensitizing nuclei embedded in the core, an emulsion containing grains each having tellurium sensitizing nuclei embedded in the near-surface region, and an emulsion containing grains each having tellurium sensitizing nuclei formed on the grain surface. Which type of an emulsion should be used depends on the purpose for which it is used.

The formula (I) will now be explained in detail.

The aliphatic groups represented by $R_1$ to $R_{10}$ in the formula (I) are preferably those having 1 to 30 carbon atoms. Particularly preferable are alkyl group, alkenyl group, alkynyl group, and aralkyl group, each having 1 to 20 carbon atoms and present in the form of a straight chain, a branch, or a ring. Examples of alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

The aromatic groups represented by $R_1$ to $R_7$ in the formula (I) are preferably those having 6 to 30 carbon atoms. Particularly preferred is aryl group having 6 to 20 carbon atoms and present in the form of a monoring or a condensed ring, such as phenyl group or naphthyl group.

The heterocyclic groups identified by $R_1$ to $R_7$ in the formula (I) are saturated or unsaturated 3- to 10-membered heterocyclic groups, each having at least one atom selected from the group consisting of a nitrogen atom, an oxygen atom and a sulfur atom. They can be each a monoring, or can combine with an aromatic ring or another heterocyclic ring, thus forming a condensed ring. Preferable are 5- or 6-membered aromatic heterocyclic group such as pyridyl, furyl, thienyl, thiazolyl, imidazolyl, and benzimidazolyl.

The cations represented by R4 and R7 in the formula (I) are of alkaline metal or ammonium.

The halogen atom identified by X in the formula (I) is, for example, a fluorine atom, a chlorine atom, a bromine atom, or a iodine atom.

The aliphatic groups, the aromatic groups, and the heterocyclic groups—all specified above—can be substituted. Typical examples of the substituents are: alkyl group, aralkyl group, alkenyl group, alkynyl group, aryl group, alkoxy group, aryloxy group, amino group, acylamino group, ureido group, urethane group, sulfonylamino group, sulfamoyl group, carbamoyl group, sulfonyl group, sulfinyl group, alkyloxycarbonyl group, aryloxycarbonyl group, acyl group, acyloxy group, phosphoric acid amide group, diacylamino group, imido group, alkylthio group, arylthio group, a halogen atom, cyano group, sulfo group, carboxyl group, hydroxyl group, phosphono group, nitro group, and heterocyclic group. These groups can be further substituted.

In the case where two or more substituents are used, they are either identical or different.

$R_1$, $R_2$, and $R_3$ can combine together and with phosphor atoms, forming a ring. $R_5$ and $R_6$ can be bound each other to form a nitrogen-containing heterocyclic ring.

In the formula (I), $R_1$, $R_2$, and $R_3$ are preferably aliphatic groups or aromatic groups. More preferably, they are alkyl groups or aromatic groups.

The general formula (II) will now be explained in detail.

The aliphatic groups represented by $R_{11}$ and $R_{13}$ to $R_{20}$ in the formula (II) are preferably those having 1 to 30 carbon atoms. Particularly preferable are alkyl group, alkenyl group, alkynyl group, and aralkyl group, each having 1 to 20 carbon atoms and present in the form of a straight chain, a branch, or a ring. Examples of alkyl group, alkenyl group, alkynyl group and aralkyl group are: methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentynyl, benzyl, and phenetyl.

The aromatic groups represented by $R_{11}$ and $R_{13}$ to $R_{20}$ in the formula (II) are preferably those having 6 to 30 carbon atoms. Particularly preferred is aryl group having 6 to 20 carbon atoms and present in the form of a monoring or a condensed ring, such as phenyl group or naphthyl group.

The heterocyclic groups identified by $R_{11}$ and $R_{13}$ to $R_{20}$ in the formula (II) are saturated or unsaturated 3- to 10-membered heterocyclic groups, each having at least one atom selected from the group consisting of a nitrogen atom, an oxygen atom and a sulfur atom. They can be each a monoring, or can combine with an aromatic ring or another heterocyclic ring, thus forming a condensed ring. Preferable are 5- or 6-membered aromatic heterocyclic group such as pyridyl, furyl, thienyl, thiazolyl, imidazolyl, and benzimidazolyl.

It is desirable that the acyl groups identified by $R_{13}$ to $R_{20}$ shown in the formula (II) have 1 to 30 carbon atoms. More preferably, they are acyl groups having 1 to 20 carbon atoms and present in the form of a straight chain or a branch. Examples of these acyl groups are acetyl, benzoyl, formyl, pivaloyl, and decanoyl.

In the case where $R_{11}$ and $R_{15}$, $R_{11}$ and $R_{17}$, $R_{11}$ and $R_{18}$, $R_{11}$ and $R_{20}$, $R_{13}$ and $R_{15}$, $R_{13}$ and $R_{17}$, $R_{13}$ and $R_{18}$, or $R_{13}$ and $R_{20}$ is bound to each other to form a ring, the bound group is, for example, alkylene group, allylene group, aralkylene group or alkenylene.

The aliphatic groups, the aromatic groups, and the heterocyclic groups, described above, can be substituted by the substituents specified as the substitutents for the general formula (I).

In the formula (II), $R_{11}$ is preferably aliphatic group, aromatic group, or $-NR_{13}(R_{14})$, and $R_{12}$ is $-NR_{15}(R_{16})$. Preferably, $R_{13}$, $R_{14}$, $R_{15}$ and $R_{16}$ are aliphatic groups or aromatic groups.

More preferably, in the formula (II), $R_{11}$ is aromatic group or $-NR_{13}(R_{14})$, $R_{12}$ is $-NR_{15}(R_{16})$, and $R_{13}$, $R_{14}$, $R_{15}$ and $R_{16}$ are alkyl groups or aromatic groups. Preferably, $R_{11}$ and $R_{15}$, and $R_{13}$ and $R_{15}$ are bound to each other in each pair to form allylene group, aralkylene group, or alkenylene group, thus forming a ring.

Specific examples of the compounds represented by the formulas (I) and (II) are as follows. It should be noted that the compounds used in the invention are not limited to these specified below.
1. $(nC_4H_9)_3P{=}Te$
2. $(tC_4H_9)_3P{=}Te$
3.
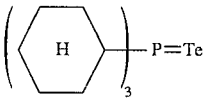
4. $((i)C_3H_7)_3P{=}Te$
5.
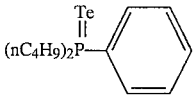
6.
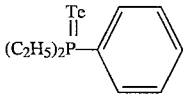
7. $((i)C_4H_9)_3P{=}Te$
8. $((i)C_4H_9)_2P(Te)C_4H_9(n)$
9. $(i)C_3H_7P(Te)(C_4H_9(n))_2$
10. $((i)C_3H_7)_2P(Te)C_4H_9(n)$
11. $(i)C_3H_7P(Te)(C_4H_9(i))_2$
12. $((i)C_3H_7)_2P(Te)C_4H_9(i)$
13. $((i)C_3H_7)_2P(Te)C_3H_{17}(n)$
14. $C_2H_5P(Te)(OC_2H_5)_2$
15. $(nC_4H_9O)_3P{=}Te$
16. $C_2H_5P(Te)\text{-}N(CH_3)_2)_2$
17.
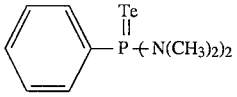
18. $((CH_3)_2N\text{-})_3P{=}Te$
19. $((CH_3)_3SiO\text{-})_2P(Te)H$
20.
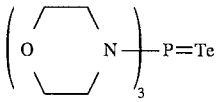
-continued
21. $(C_2H_5)_2PN(C_2H_5)_2(Te)$
22. $H_2PNH_2(Te)$
23.
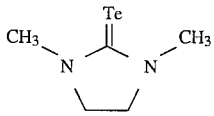
24.
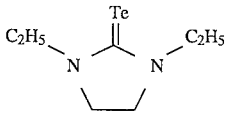
25.
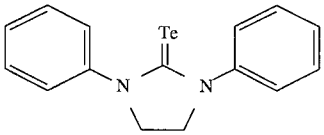
26.
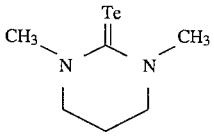
27.
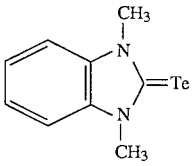
28.
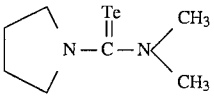
29.
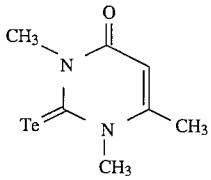
30.
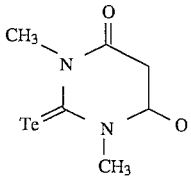
31.
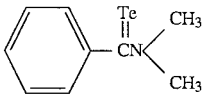
32.
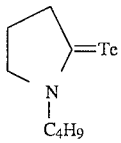

-continued

33.

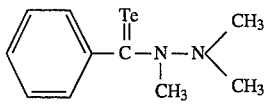

34.

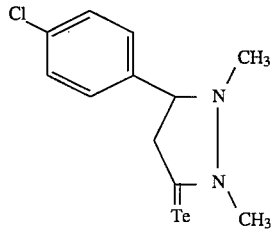

35.

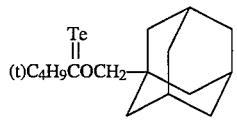

36.

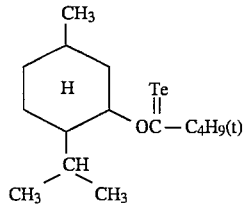

37.

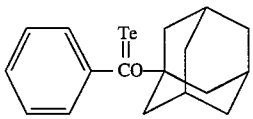

38.

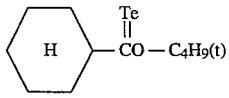

The compounds of the formulas (I) and (II), which are used in this invention, can be synthesized by the methods known in the art, as is disclosed in Journal of Chemical Society (A), 2927 (1969), Journal of Organometallic Chemistry, 4,320 (1965), ibid, 1,200 (1963), ibit, 113, C35 (1976), Phosphorus Sulfur 15, 155 (1983), Chemische Berichte, 109, 2996 (1976), Journal of Chemical Society Chemical Communication, 635 (1980), ibid, 1102 (1979), ibid, 645 (1979), ibid, 820 (1987), Journal of Chemical Society Perkin Transaction 1,2191 (1980), The Chemistry of Organo Selenium and Tellurium Compounds, Vol. 2, pp. 216–267 (1987).

The size of the grains contained in the emulsion used in the invention can be evaluated in terms of circle-equivalent diameter (i.e., the diameter of a circle having the same area as the projected image of a grain) or sphere-equivalent diameter calculated from the projected area and thickness of the grain, both the circle-equivalent diameter and the sphere-equivalent diameter measured by means of an electron microscope. Alternatively, the size of the grains can be evaluated in terms of sphere-equivalent diameter of a volume measured by using colter counter.

The distribution of grain size can be presented in terms of the variation coefficient of the circle-equivalent diameter or sphere-equivalent diameter. If the emulsion used is a monodispersed one, it should better have a variation coefficient of 22% or less, preferably 18% or less, more preferably 15% or less.

The silver halide grains used in this invention are made of silver bromide, silver chloride, silver iodide, silver chlorobromide, silver chloroiodide, silver iodobromide, or silver chlorobromoiodide. The emulsion used in the invention can contain not only these silver halide grains, but also grains of any other silver salt, such as silver rhodanide, silver sulfide, silver selenide, silver carbonate, silver phosphate or silver salt of organic acid. Alternatively, a part of each silver halide grain can be made of such silver salt.

To prepare a silver halide photographic light-sensitive material which can be developed and desilvered (i.e., bleached, fixed and bleach-fixed) at high speeds, it is desirable that the silver halide grains have a high silver chloride content. To suppress a development of a silver halide photographic light-sensitive material adequately, it is preferable that the silver halide grains contain silver iodide. The optimum amount of silver iodide depends on the type of the light-sensitive material. Preferably, the silver iodide content is 0.1 to 15 mol % for X-ray sensitive material, and 0.1 to 5 mol % for microfilm and graphic art film. For photographic light-sensitive materials the typical example of which is color negative film, the silver iodide content ranges from 1 to 30 mol %, preferably 5 to 20 mol %, more preferably 8 to 15 mol %. In order to lessen lattice strain in each silver halide grain, it is recommendable that silver chloride be contained in the silver iodobromide grain.

It is desirable that the silver halide emulsion for use in this invention contain grains in which a distribution is present with respect to a halogen composition and having a specific structure. Typical example of such grains are those of double structure, or of a core and shell type which have different halogen compositions, as is disclosed in JP-B-43-13162, JP-A-61-215540, JP-A-60-222845, JP-A-60-143331, JP-A-61-75337, and some other references. ("JP-A" means Published Unexamined Japanese Patent Application, and "JP-B" means Published Examined Japanese Patent Application.) Other examples of such grains are: those of triple structure, each formed of a core, a first shell and a second shell which have different halogen compositions, or of multiple layer structure, as is disclosed in JP-A-60-222844; and those of double structure having a core and a shell, each coated with a thin layer of silver halide which has a halogen composition different from those of the core and shell.

Apart from the grains of the three types described in the preceding paragraph, grains having so-called "junction structure" can be used in the present invention in order to form a structure inside the grains. Various examples of grains having the junction structure are disclosed in JP-A-59-133540, JP-A-58-108526, European Patent 199,290A2, JP-B-58-24772, JP-A-59-16254, and some other references.

In the case of silver halide grains formed of two or more kinds of silver halides which are present in the form of a mixed crystal or having particular structure, it is important to control the halogen distribution among the grains. A method of measuring the halogen distribution is disclosed in JP-A-60-254032. The more uniform the halogen distribution among the grains, the better. An silver halide emulsion containing grains whose variation coefficient is 20% or less is particularly desirable. Another preferable emulsion is one in which the grain size is correlated to the halogen composition of the grain. In an example of such emulsion, the iodine content of each grain is proportional to its size. A silver halide emulsion can be used in which the iodide content of each grain is inversely proportional to the grain size, or in which the grain size and the content of any other halogen are correlated, in accordance with the use of the light-sensitive material. In view of this it would be recommendable that two or more emulsions having different composition be mixed and used.

It is also important to control the halogen composition in the near-surface region of the grain. More specifically, the content of silver iodide or silver chloride in the near-surface region should be increased to change the dye-adsorbing efficiency or developing speed of the grain, in accordance with the use of the light-sensitive material.

Silver halide grains suitable for use in this invention are regular grains which have no twinning planes. Among these regular crystals are: cubic crystals having (100) faces; octahedral crystals having (111) faces; and dodecahedral grains having (110) faces, disclosed in JP-B-55-42737 and JP-A-60-222842. Also, the grains having (h11)faces such as (211) faces, the grains having (hh1) faces such as (331) faces, the grains having (hk0) faces such as (210) faces, and the grains having (hk1) faces such as (321) faces—all described in Journal of Imaging Science, Vol. 30, p. 247 (1986)—can be used for specific purposes, though some cares must taken to prepare these grains.

The ratio of the circle-equivalent diameter of the projected area of a grain to the thickness of the grain is known as "aspect ratio" in the art. The aspect ratio define a figure of a tabular grain. Tabular grains having an aspect ratio of 1 or more can be preferably used in the present invention. In the case of using tabular grains, there are advantages such as an increase in covering power and an increase in efficiency of spectral sensitization by sensitizing agents as described in detail in U.S. Pat. No. 4,434,226.

It is desirable that tabular grains having average aspect ratios of 1 or more but less than 100, preferably 2 or more but less than 20, more preferably 3 or more but less than 10, occupy 80% or more of the total projected area of all tabular grains. The tabular grains can be of various shapes, such as triangular, hexagonal, and circular. Preferable are hexagonal tabular grains, each having the six sides of substantially the same length, which are disclosed in U.S. Pat. No. 4,797,354.

The dislocation line of a tabular grain can be observed by means of a transmission electron microscope. Tabular grains having no dislocation lines, tabular grains each having a few dislocation lines, or tabular grains each having many dislocation lines can be used, in accordance with the purpose of using the grains. Of these types of tabular gains, those having dislocation lines are preferable.

Solvents for silver halide is useful in preparing the emulsion for use in this invention. Examples of such solvents are: ammonia; thiocyanate (e.g., potassium rhodanide or rhodan ammonium); organic thioether compound (e.g., those disclosed in U.S. Pat. Nos. 3,574,628, 3,021,215, 3,057,724, 3,038,805, 4,276,374, 4,297,439, 3,704,130 and 4,782,013, and JP-A-57-104926); thione compound (e.g., tetra-substituted thiourea disclosed in JP-A-53-82408, JP-A-55-77737, and U.S. Pat. No. 4,221,863, or the compound disclosed in JP-A-53-144319); mercapto compound (e.g., the compound disclosed in JP-A-57-202531 which can accelerate the growth of silver halide grains); and amine compound (e.g., the compound disclosed in JP-A-54-100717).

The silver halide emulsion used in the present invention can be sensitized by another sensitization such as sulfur sensitization, selenium sensitization, noble metal sensitization (e.g., gold sensitization or palladium sensitization), or reduction sensitization. The sensitization or sensitizations can be performed in any of steps, thereby preparing emulsions of different types. Among these types of emulsions are: an emulsion which contains grains each having chemically sensitized nuclei inside the grains; an emulsion which contains grains each having chemically sensitized nuclei in the near-surface region; and an emulsion which contains grains each having chemically sensitized nuclei formed on the surface. Of these emulsions, one containing grains each having chemically sensitized nuclei of at least one type formed in the near-surface region is generally desirable.

Examples of gold sensitizers are chloroaurate, potassium chloroaurate, potassium aurithiocyanate, gold sulfide, and gold selenide—all being known compounds. Examples of palladium sensitizers are palladium compounds which are bivalent palladium salt or tetravalent palladium salt. Preferable palladium compounds are those identified by $P_2PdX_6$ and $R_2PdX_4$, where R is a hydrogen atom, an alkaline metal atom, or an ammonium group, and X is a halogen atom such as chlorine, bromine or iodine.

Usable as sulfur sensitizers are: hypo thioureaseries compounds, rhodanine-series compounds, and sulfur-containing compounds disclosed in U.S. Pat. Nos. 3,857,711, 4,266,018 and 4,054,457.

The silver halide emulsion can be chemically sensitized in the presence of a so-called "chemical sensitization additive." Known as useful chemical sensitization additives are compounds such as azaindene, azapryidadine, and azapyrimidine, which not only control fog but also enhance sensitivity in the process of chemical sensitization.

One of the sensitizations which are preferably applied to the emulsion for use in the invention is selenium sensitization. To achieve selenium sensitization, use can be made of known unstable selenium compounds such as colloidal metal selenium, selenoureas (e.g., N,N-dimethyl selenourea and N,N-diethyl selenourea), selenoketones, and selenoamides. In some cases, selenium sensitization should better be employed, along with sulfur sensitization or noble metal sensitization, or both.

Preferably, the silver halide emulsion is subjected to reduction sensitization, during the forming of grains, after the forming of grains but before the chemical sensitization, during the chemical sensitization, or after the chemical sensitization.

The reduction sensitization can be a method in which a reduction sensitizer is added to the silver halide emulsion, silver ripening in which the emulsion is precipitated or ripened in a low-pAg atmosphere having a pAg value ranging from 1 to 7 is performed, or high-pH ripening in which the emulsion is precipitated or ripened in a high-pH atmosphere having a pH value ranging from 8 to 11 is performed. Two or all of these methods can be used in combination. Of these methods, the method of adding a reduction sensitizer to the emulsion is preferable in that the level of reduction sensitization can be adjusted minutely.

Examples of the reduction sensitizer are known compounds such as stannous salt, ascorbic acid, derivative thereof, amine, polyamine, hydrazine derivative, formamidine sulfinic acid, silane compound, and borane compound.

It is desirable that an oxidizing agent be used for oxidizing silver during the preparation of the emulsion. The agent for oxidizing silver is a compound which acts on metal silver, thus forming silver ions.

Preferable as an oxidizing agent for use in the present invention is ozone, hydrogen peroxide, adduct thereof, halogen element, inorganic oxidizing agent such as thiosulfonate, or organic oxidizing agent such as quinone.

The photographic emulsion used in the invention can contain various compounds to prevent fogging from occurring during the manufacture, storage or processing of the light-sensitive material, and to stabilize the photographic properties of the light-sensitive material. More precisely, compounds known as antifoggants and stabilizing agents can be added to the emulsion. Examples of these compounds are: thiazoles such as benzothiazolium salt; nitroindazoles; nitrobenzimidazoles; chlorobenzimidazoles; bromobenzimidazoles; mercapto thiazoles; mercapto benzthiazoles; mercapto benzimidazoles; mercapto thiadiazoles; aminotriazoles; benztriazoles; nitrobenztriazoles; mercapto tetrazoles, particularly, 1-phenyl-5-mercapto tetrazole; mercapto pyrimidines; mercapto triazines; thioketo compounds such as oxadolinethione; azaindenes such as triazaindene and tetrazaindene (particularly, 4-hydroxy-substituted (1, 3, 3a, 7) tetrazaindenes); pentazaindenes. The compounds disclosed in, for example, U.S. Pat. Nos. 3,954,474 and 3,982,947 and JP-B-52-28660 can be used as antifoggants and stabilizing agents. One of compounds which are preferable for use in the invention is disclosed in JP-A-63-212932.

These antifoggants and stabilizing agents can be added before, during or after the forming of grains, during water-washing, during the dispersion process subsequent to the water-washing, before, during or after chemical sensitization, or before coating process, in accordance with the purpose for which the antifoggants and the stabilizing agents are used. The antifoggants and the stabilizing agents can be used, not only to prevent fogging and stabilize the photographic properties of the light-sensitive material, but also to control the crystal habit, reduce the grain size, decrease the solubility of the grain, control the chemical sensitization, and control the adsorption of dye.

It is desirable that the photographic emulsion used in the invention be spectrally sensitized with methine dyes or the like. Examples of the dyes used are: cyanine dye, merocyanine dye, complex cyanine dye, complex merocyanine dye, holopoler cyanine dye, hemicyanine dye, styrene dye, and hemioxonol dye. Of these dyes, particularly useful are those belonging to cyanine dye, merocyanine dye, and complex merocyanine dye. These dyes may contain nuclei which are usually used in cyanine dyes as basic heterocyclic nuclei. Examples of the nuclei are nuclei such as pyrroline, oxazoline, thiazoline, pyrrole, oxazole, thiazole, selenazole, imidazole, tetrazole, and pyridine; nuclei each formed of any one of these nuclei and an alicylic hydrocarbon ring fused to the nucleus; and nuclei each formed of any one of these nuclei and an aromatic hydrocarbon ring fused to the nucleus, such as indolenine, benzindolenine, indole, benzoxadole, naphthoxazole, benzthiazole, naphthothiazole, benzoselenazole, benzimidazole, and quinoline. These nuclei can be substituted at carbon atoms.

Merocyanine dye or complex merocyanine dye can be one which has nuclei of ketomethylene structure. Examples of the nuclei are 5- or 6-membered heterocyclic nuclei such as pyrazoline-5-on, thiohydantoin, 2-thiooxazolidine-2,4-dione, thiazolidine-2,4-dione, rhodanine or thiobarbituric acid.

These sensitizing dyes can be used, either singly or in combination. In many cases, they are used in combination, for achieving supersensitization, as is disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618, and JP-A-52-109925.

According to the present invention, the emulsion can contain not only the sensitizing dye, but also a dye which has no sensitizing ability or a substance which absorbs virtually no visible light and has supersensitizing ability.

The sensitizing dye can be added at any time that has been hitherto known as useful during the preparation of any emulsion. In most cases, the dye is added after the chemical sensitization and before the coating of the emulsion. It can be added at the same time the chemical sensitizer is added, thereby to accomplish spectral sensitization and chemical sensitization at the same time, as is disclosed in U.S. Pat. Nos. 3,628,969 and 4,225,666. Alternatively, it can be added before the chemical sensitization, to initiate spectral sensitization, as is described in JP-A-58-113928. Also, it can be added before the precipitation of silver halide grains, to initiate spectral sensitization. Still alternatively, it can be added in two portions before and after chemical sensitization, respectively, as is disclosed in U.S. Pat. No. 4,225,666. Moreover, it can be added at any time during the forming of silver halide grains, as is described in U.S. Pat. No. 4,183,756.

The amount in which to add the sensitizing dye is $4\times10^{-6}$ to $8\times10^{-3}$ mol per mol of silver halide used. Preferably, the dye is added in an amount of $5\times10^{-5}$ to $2\times10^{-3}$ mol per mol of silver halide, in the case the silver halide grains used have sizes ranging from 0.2 to 1.2 mm.

Not only the additives described above, but also other additives are used in the light-sensitive material according to the invention, in accordance to the use of the material. These additives are described in Research Disclosure Item 17643 (December 1978), Research Disclosure Item 18716 (November 1979), and Research Disclosure Item 308119 (December 1989), as is listed in the following table:

| Additives | RD No. 17643 | RD No. 18716 | RD 308119 |
|---|---|---|---|
| 1. Chemical sensitizers | page 23 | Page 648, right column | page 996 |
| 2. Sensitivity increasing agents | | Page 648, right column | |
| 3. Spectral sensitizers Super sensitizers | page 23–24 | page 648, right column to page 649, right column | page 996, right column to page 998, right column |
| 4. Brighteners | page 24 | | page 998, right column |
| 5. Antifoggants and Stabilizers | pages 24–25 | page 649, right column | page 998, right column to page 1000, right column |
| 6. Light absorbent, Filter dye, Ultraviolet absorbents | page 25–26 | page 649, right column to page 650, left column | page 1003, left column to page 1003, right column |
| 7. Stain preventing agents | page 25, right column | page 650, left to right columns | |
| 8. Dye image stabilizer | page 25 | | |
| 9. Hardening agents | page 26 | page 651, left column | page 1004, right column column to page 1005, left column |
| 10. Binder | page 26 | page 651, left column | page 1003, right column to page 1004, right column |
| 11. Plasticizers, Lubricants | page 27 | page 650, right column | page 1006, left column to page 1006, right column |
| 12. Coating aids, surface active agents | pages 26–27 | page 650, right column | page 1005, left column to page 1006, left column |
| 13. Antistatic agents | page 27 | page 650, right column | page 1006, right column to page 1007, left column |

The present invention can be applied to a color photographic light-sensitive material.

The light-sensitive material according to the present invention need only have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color but has different speed. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer. In other words, three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464. In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted.

Furthermore, the arrangement can be changed as described above even when four or more layers are formed.

As described above, various layer types and arrangements can be selected in accordance with the application of the light-sensitive material.

In the light-sensitive material of the invention, two or more emulsions can be used in the form of a mixture, which are different in at least one of properties, i.e., grain size, grain-size distribution, the halogen composition of the grains, the shape of the grains, and sensitivity.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloidal layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

Non-light-sensitive fine silver halide grains should better be used in the present invention. The term "non-light-sensitive fine silver halide grain" means a fine silver halide grain which does not sense light when the material is subjected to imagewise exposure to form a dye image, and which is not developed when the material is developed. It is desirable that the non-light-sensitive fine grains be not fogged at all.

The fine silver halide grains contain 0 to 100 mol % of silver bromide. If necessary, they can contain silver chloride and/or silver iodide. Preferably, they contain 0.5 to 10 mol % of silver iodide.

Preferably, the fine silver halide grains have an average size (i.e., average circle-equivalent diameter) of 0.01 to 0.5 μm. More preferably, they have an average size of 0.02 to 0.2 μm.

A coating silver amount of the light-sensitive material of the present invention is preferably 6.0 $g/m^2$ or less, and more preferably, 4.5 $g/m^2$ or less.

In order to prevent degradation in photographic properties caused by formaldehyde gas, a compound which can react with and fix formaldehyde described in U.S. Pat. No. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in EP 317, 308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and RD No. 307105, VII-C to VII-G.

Preferable examples of a yellow coupler are described in, e.g., U.S. Pat. Nos. 3,933,501, 4,022,620, 4,326,024, 4,401, 752, and 4,248,961, JP-B-58-10739, British Patents 1,425, 020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725, 067, Research Disclosure No. 24220 (June 1984), JP-A-60-33552, Research Disclosure NO. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol and naphthol couplers, and preferably, those described in, e.g., U.S. Pat. Nos. 4,052,212, 4,146,396, 4,228,233, 4,296,200, 2,369, 929, 2,801,171, 2,772,162, 2,895,826, 3,772,002, 3,758,308, 4,343,011, and 4,327,173, West German Patent Application (OLS) No. 3,329,729, EP 121,365A and 249,453A, U.S. Pat. Nos. 3,446,622, 4,333,999, 4,775,616, 4,451,559, 4,427, 767, 4,690,889, 4,254,212, and 4,296,199, and JP-A-61-42658.

Typical examples of a polymerized dye-forming coupler are described in U.S. Pat. Nos. 3,451,820, 4,080,221, 4,367, 282, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G, RD No. 307105 VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor are described in the patents cited in the above-described RD No. 17643, VII-F, and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator when the light-sensitive material is developed are described in British Pat. Nos. 2,097,140 and 2,131,188, JP-A-59-157638, and JP-A-59-170840. In addition, compounds for releasing a fogging agent, a development accelerator, or a silver halide solvent upon redox reaction with an oxidant of a developing agent, described in JP-A-60-107029, JP-A-60-252340, JP-A-1-44940, and JP-A-1-45687, can also be preferably used.

Examples of an another compound which can be used in the light-sensitive material of the present invention are competing couplers described in, e.g., U.S. Pat. No. 4,130, 427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a bleaching accelerator releasing coupler described in, e.g., RD. No. 11449, RD. No. 24241 and JP-A-61-201247; a legand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers used in this invention can be added by various dispersion methods known hitherto.

Examples of a high-boiling organic solvent to be used in the oil-in-water dispersion method are described in, for example, U.S. Pat. No. 2,322,027. Specific examples of a high-boiling organic solvent to be used in the oil-in-water dispersion method and having a boiling point of 175° C. or more at atmospheric pressure are: phthalate esters (e.g., dibutyl phthalate, dicyclohexyl phthalate, di-2-ethylhexyl phthalate, decyl phthalate, bis (2,4-di-t-amylphenyl) phthalate, bis (2,4-di-t-amylphenyl) isophthalate, and bis (1,1-diethylpropyl)phthalate); phosphate esters and phosphonate esters (e.g., tripheyl phosphate, tricresyl phosphate, 2-ethyhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate); benzoate esters (e.g., 2-ethylhexyl benzoate, dodecyl benzoate, and 2-ethylhexyl-p-hydroxy benzoate); amides (e.g., N,N-diethyldodecane amide, N,N-diethyllauryl amide, and N-tetradecyl pyrrolidone); alcohols and phenols (e.g., isostearyl alcohol and 2,4-di-tert-amyl phenol); aliphatic carbonate esters (e.g., his (2-ethylhexyl) sebacate, dioctylazelate, glycerol tributylate, isostearyl lactate, and trioctyl citrate); aniline derivatives (e.g., N,N-dibutyl-2-butoxy-5-tert-octylaniline); and hydrocarbons (e.g., paraffin, dodecyl benzene, and diisopropyl naphthalene). Also, an organic solvent having a boiling point of about 30° C. or more, preferably 50° C. to 160° C. can be used as auxiliary solvent. Typical examples of the auxiliary solvent are ethyl acetate, butyl acetate, ethyl propionate, methylethyl ketone, cyclohexanone, 2-ethoxyethyl acetate, and dimethylformamide.

Steps and effects of a latex dispersion method and examples of an impregnating latex are described in, e.g., U.S. Pat. No. 4,199,363 and West German Pat. No. Application (OLS) Nos. 2,541,274 and 2,541,230.

Various types of an antiseptic agent or an antifungal agent are preferably added to the color light-sensitive material according to the present invention. Examples of the antiseptic agent and the antifungal agent are phenethyl alcohol, and 1,2-benzisothiazoline-3-one, n-butyl p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the hydrophilic colloid layers formed on the side having emulsion layers have a total film thickness of 28 μm or less, preferably 23 μm or less, more preferably 18 μm or less and most preferably 16 μm or less. The term "total film thickness" means the thickness which is measured after the material has been left to stand for two days at 25° C. and relative humidity of 55%.

The light-sensitive material according to the invention has a film swell speed $T_{1/2}$ which is preferably 30 sec. or less, and more preferably, 20 sec. or less. The film swell speed $T_{1/2}$ can be measured in accordance with a known method in the art. For example, it can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a hardening agent to gelatin as a binder or changing aging conditions after coating. A swell ratio is preferably 150% to 400%. The swell ratio is calculated from the maximum swell film thickness measured under the above conditions in accordance with a following formula:

$$\frac{\text{maximum swell film thickness} - \text{film thickness}}{\text{film thickness}}$$

In the light-sensitive material of the present invention, hydrophilic colloidal layers (called back layers) having a total driedal film thickness of 2 to 20 μm are preferably formed on the side opposite to the side having emulsion layers. The back layers preferably contain, a light absorbent, a filter dye, an ultraviolet absorbent, an antistatic agent, a hardener, a binder, a plasticizer, a lubricant, a coating aid, and a surfactant, described previously. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 615, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-b-hydroxyethylaniline, 3-methyl-4-amino-N-ethyl-N-b-methanesulfonamide ethyl aniline, 3-methyl-4-amino-N-ethyl-N-b-methoxyethyl aniline, sulfates thereof, hydrochlorides thereof, and p-toluenesulfonates thereof. Of these compounds, 3-methyl-4-amino-N-ethyl-N-b-hydroxyethyl aniline sulfate is particularly preferred. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine, e.g., N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; a fogging agent such as sodium boron hydride; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, 1-hydroxyethylidene-1,1-diphosphonic acid, nitrilo-N,N,N-trimethylenephosphonic acid, ethYlenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof. The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenisher. In order to decrease the replenishment amount, a contact area of the developer with air in a processing tank is preferably decreased to prevent evaporation and oxidation of the solution upon contact with air.

The contact area of the processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a replenishing amount can be reduced by using a means of suppressing accumulation of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III); peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as ethylenediaminetetraacetateferrate (III) or 1,3diaminopropanetetraacetateferrate (III) is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopoly carboxylic acid is normally 4.0 to 8. In order to increase the processing speed, however, processing can be performed at a lower pH.

A bleaching accelerator can be used in the bleaching solution, the bleach-fixing solution, and their prebath, if necessary. Useful examples of the bleaching accelerator are: compounds having a mercapto group or a disulfide group described in, e.g., U.S. Pat. No. 3,893,858, west German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivatives disclosed in JP-B-45-8506, JP-A-52-20832, JP-A-53-32735, and U.S. Pat. No. 3,706,561; iodide salts described in German Patent 1,127,715 and JP-A-58-16235; poly oxyethylene compounds descried in west German Patents 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid or hydroxyacetic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing or bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/ % of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing mode representing a counter or forward current, and other conditions. The relationship between the amount of water and the number of water tanks in a multi-stage counter-current mode can be obtained by a method described in "Journal of the Society of Motion Picture and Television Engineering", Vol. 64, PP. 248–253 (May, 1955). In the multi-stage counter-current mode disclosed in this reference, the amount of water used for washing can be greatly decreased. Since washing water stays in the tanks for a long period of time, however, bacteria multiply and floating substances produced may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole, described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bobai Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surfactant to be used as a final bath of the photographic color lightsensitive material. Examples of the dye stabilizing agent are aldehydes such as formalin and glutaraldehyde, N-methyrol compounds, hexamethylene tetramines, and aldehyde sulfite adducts. Further, various cheleting agents and antifungal agents can be added to the stabilizing bath.

An overflow solution produced upon washing and/or replenishment of the stabilizing solution can be resued in another step such as a desilvering step.

In the processing using an automatic developing machine or the like, if each processing solution described above is condensed by evaporation, water is preferably added to correct condensation.

The silver halide color light-sensitive material according to the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material according to the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to light-sensitive materials for heat development described in, for example, U.S. Pat. No. 4,500,626, JP-A-60-133449, JP-A-59-218443, JP-A-61-238056, and EP 210,660A2.

The present invention will be described in more detail below by way of its examples, but the present invention is not limited to these examples.

EXAMPLE 1

Emulsions A and B were prepared by the methods which will be described below.

First, 0.5M aqueous silver nitrate solution, and aqueous halogen salt solution containing 0.1M potassium bromide, 0.44M sodium chloride, potassium hexachloroiridate (III) and ammonium hexabromorhodate (III) were added to aqueous gelatin solution containing sodium chloride, 1,3-dimethylimidazolidine-2-thione and benzenthiosulphonic acid and having its pH adjusted to 4.0, over 10 minutes by means of doubled jet method, while the aqueous gelatin solution was being stirred and maintained at 38° C. As a result of this, silver chlorobromide grains were formed, thus forming nuclei in the resultant solution; the grains had an average size of 0.16 μm and contained 70 mol % of silver chloride. Next, 0.5M aqueous silver nitrate solution and aqueous halogen salt solution containing 0.1M potassium bromide and 0.44M sodium chloride were added to the solution, over 10 minutes by means of the doubled jet method, thereby growing grains. The grains, thus obtained, were cubic silver chlorobromide grains which had an average grain size of 0.2 μm and contained 70 mol % of silver chloride, $3.8\times10^{-7}$ mol of Ir per mol of silver, and $6.1\times10^{-8}$ mol of Rh per mol of silver (variation coefficient: 10%). Then, the solution was washed with water by means of flocculation, and 30 g of gelatin was added to the solution, thereby preparing emulsion A. Emulsion A was distributed into two portions. Iridium and rhodium were removed from the second portion, thereby forming emulsion B. Then, emulsions A and B were subjected to sulfur sensitization and tellurium sensitization by the methods which will be described below, thereby preparing samples 101 to 107 specified in Table 1 represented hereinafter.

Sulfur Sensitization

The pH value and pAg value of the emulsion were adjusted to 5.6 and 7.5, respectively. Next, 3.2 mg of sodium thiosulfate and 4.3 mg of chloroaurate were added to the emulsion. The resultant mixture was chemically sensitized at 65° C., so that it might have an optimal sensitivity. Then, 75 mg of 4-hydroxy-6-methyl-1,3, 3a,7-tetraazaindine, used as stabilizing agent, was added to the chemically sensitized mixture.

Tellurium Sensitization

The pH value and pAg value of the emulsion were adjusted to 5.6 and 7.5, respectively. Next, 1.2 mg of sodium thiosulfate, a tellurium sensitizer, and 4.3 mg of chloroaurate were added to the emulsion. The resultant mixture was ripened at 55° C., so that it might have an optimal sensitivity. Then, 75 mg of 4-hydroxy-6-methyl-1,3,3a,7-tetraazaindine, used as stabilizing agent, was added to the chemically sensitized mixture.

Dye 1 represented by the following formula was added to emulsion A and B, in an amount of 40 mg per mob of silver.

Dye 1

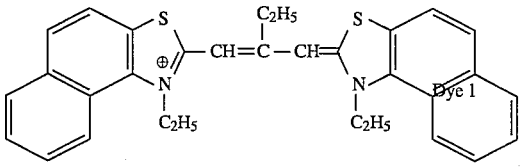

Further, 4,4'-bis (4,6-dinaphthoxy-pyrimidine-2-ylamino)-stilbenedisulfonate disodium salt was added to emulsions A and B, in an amount of 234 mg per mol of silver. Also, 1-phenyl-5-mercapto tetrazole was added to either emulsion in an amount of 25 mg per mob of silver. Then, hydroquinone was added in an amount of 150 mg/m$^2$, polyethylacrylate latex was added in a gelatin-binder ratio of 30%, 0.01 μm colloidal silica was added in a gelatin-binder ratio of 30%, and 2-bis (vinylsulfonylacetamide) ethane, used as hardener, in an amount of 70 mg/m$^2$. Emulsions A and B were coated on polyester supports, such that the amount of silver coated was 3.2 g/m$^2$ and the amount of gelatin coated was 1.4 g/m$^2$. Also, a protective layer was formed on the top emulsion layer, by coating a solution. This solution had a pH value of 5.5 and comprised gelatin used in an amount of 0.5 g/m$^2$, the dye of the following formula used in an amount of 70 mg/m$^2$, and polymethyl methacrylate (i.e., matting agent; grain size: 2.5 μm) used in an amount of 60 mg/m$^2$, colloidal silica (grain size: 10 μm) used in an amount of 70 mg/m$^2$, sodium dodecylbenzene sulfonate (i.e., a coating aid) and the fluorine-containing surfactant of the following formula used in a combined amount of 1.5 mg/m$^2$, and a chelating agent used in an amount of 20 mg/m$^2$.

Dye

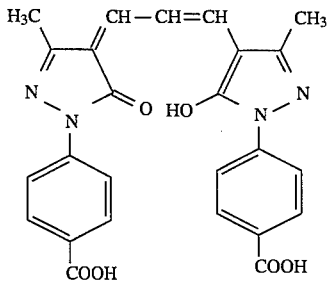

Surfactant

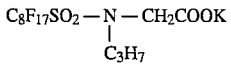

The base layer used in Example 1 had a back layer and a back protective layer, the compositions of which were as follows:

| | |
|---|---|
| 1) Back layer | |
| Gelatin | 2.0 g/m$^2$ |
| Sodium dodecylbenzene sulfonate | 80 mg/m$^2$ |
| 1,3-divinylsulfone-2-propanol | 60 mg/m$^2$ |
| 2) Back protective layer | |
| Gelatin | 0.5 g/m$^2$ |

-continued

| | |
|---|---|
| Polymethylmethacrylate (grain size: 4.7 μm) | 30 mg/m$^2$ |
| Sodium dodecylbenzen sulfonate | 20 mg/m$^2$ |
| Fluorine-containing surfactant | 2 mg/m$^2$ |
| Silicone oil | 100 mg/m$^2$ |

Evaluation of Photographic Property

The samples, prepared as described above, were exposed to xenon flash light emitted for $10^{-5}$ seconds and applied to the samples through an interference filter having a peak at 633 nm and also through a continuous wedge. The samples, thus exposed, were developed at a predetermined temperature for a predetermined time, both specified below, by means of automatic developing apparatus FG-710NH (manufactured by Fuji Film).

| | | |
|---|---|---|
| Developing | 38 | 14 sec. |
| Fixing | 37 | 9.7 sec. |
| Water washing | 26 | 9 sec. |
| Squeezing | | 2.4 sec. |
| Drying | 55 | 8.3 sec. |
| Total time | | 43.4 sec. |
| Linear speed | | 2800 mm/min. |

The developing solution and the fixing solution, used in the development, were of the compositions specified below:

| | |
|---|---|
| 1) Developing solution | |
| Potassium hydroxide | 10 g |
| 1-hydroxyethylidene-1,1-diphosphonic acid | 2.6 g |
| Potassium bromide | 3.3 g |
| 5-methylbenzotriazole | 0.08 g |
| Sodium 2-mercapto benzimidazole-5-sulfonate | 0.3 g |
| Potassium sulfite | 83 g |
| Hydroquinone | 35 g |
| 4-hydroxymethyl-4-ethyl-1-phenyl-3-pyrazolidone | 1.3 g |
| Diethylene glycol | 30 g |
| Water to make | 1 l |
| (Sodium hydroxide added, adjusting pH to 10.7) | |
| 2) Fixing Solution | |
| Ammonium thiosulfate | 150 g |
| 1,4,5-trimethyl-1,2,4-triazolium-3-thiolate | 0.25 mol |
| Sodium bisulfite | 30 g |
| Disodium ethylenediamine tetraacetate dihydrate | 0.025 g |
| Water to make | 1 l |
| (Sodium hydroxide added, adjusting pH to 6.0) | |

Evaluation of Sensitivity and Gradation

Sensitivity of each of the samples was measured in terms of the logarithm of such an exposure amount as impart density of 3.0, and evaluated as relative sensitivity. Also, the gradation of each sample was measured in terms of the inclination of the line connecting the points of densities of 0.1 and 3.1, on the characteristic curve of the sample. The results of evaluation were as is shown in the following Table 1.

TABLE 1

| Sample | Emulsion | Chemical Sensitization | Relative Sensitivity | gradation | |
|---|---|---|---|---|---|
| Sample 101 | B | Sulfur Sensitization | 250 | 2.6 | Comp. Example |
| Sample 102 | B | Tellurium Sensitization Compound 10 2.0 mg | 280 | 2.2 | Comp. Example |
| Sample 103 | A | Sulfur Sensitization | 100 | 6.1 | Comp. Example |
| Sample 104 | A | Tellurium Sensitization Compound 10 2.0 mg | 150 | 6.8 | Invention |
| Sample 105 | A | Tellurium Sensitization Compound 15 1.8 mg | 140 | 6.6 | Invention |
| Sample 106 | A | Tellurium Sensitization compound 12 2.2 mg | 135 | 6.4 | Invention |
| Sample 107 | A | Tellurium Sensitization compound 23 | 115 | 6.3 | Invention |

As is evident from Table 1, emulsion B, which contained neither iridium nor rhodium, was indeed chemically sensitized with a tellurium compound to some extent, but failed to have so high gradation as is required of light-sensitive material for use in printing. A portion of emulsion A containing both iridium and rhodium was sulfur-sensitized, providing an emulsion which exhibited high-contrast characteristic, but had very low sensitivity. On the other hand, another portion emulsion A was sensitized with the tellurium compound, providing an emulsion which not only exhibited high-contrast characteristic, but also possessed a high sensitivity, and which could therefore serve to manufacture light-sensitive materials for use in printing.

Both high sensitivity and high contrast characteristic can be found in emulsions which are identical to emulsion A, except that it contains osmium and rhenium, not iridium and rhodium.

EXAMPLE 2

Tabular silver halide grains, which were hexagonal, parallel twinning planes and had a narrow size distribution, were prepared by the method disclosed in U.S. Pat. No. 4,797,354. More precisely, a tabular core of silver bromide was first formed, then the first shell of iodobromide containing 11 mol % of silver iodide was formed, covering the silver bromide core. Next, the second shell of silver iodobromide containing 13 mol % of silver iodide was formed, covering the first shell. The core, the first shell, and the second shell had silver contents of 8%, 59%, and 33%, respectively. The tabular grains, thus prepared, had an average diameter of 0.85 μm, and a variation coefficient with respect to their sizes was 19%. They had an aspect ratio (i.e., the thickness-to-diameter ratio) was 9.5. These grains were observed under a transmission electron microscope, and it was revealed that they had dislocation lines extending at fringes. An emulsion containing these silver halide grains was prepared, which will be referred to as "emulsion E-1."

Emulsion E-1 was desalinated and re-dispersed. The spectral sensitizing dye for use in the layer 5 of the light-sensitive layer (described later) was added to emulsion E-1. Also, two portions of emulsion E-1 were chemically sensitized by the following two methods, respectively:

Sulfur Sensitization

Sodium thiocyanate in an amount of $2\times10^{-3}$ mol per mol of silver halide, chloroaurate in an amount of $2.0\times10^{-6}$ mol per mol of silver halide, and sodium thiosulfate in an amount of $4.0\times10^{-6}$ mol per mol of silver halide were added to the first portion of emulsion E-1. The resultant mixture was ripened at 61° C. for 65 minutes and thereby chemically sensitized to the most appropriate degree.

Tellurium Sensitization

Sodium thiocyanate chloroaurate in an amount of $3.5\times10^{-6}$ mol per mol of silver halide, sodium thiosulfate in an amount of $1.5\times10^{-6}$ mol per mol of silver halide, and a tellurium sensitizer (i.e., compound 10) in an amount of $3.5\times10^{-6}$ mol per mol of silver halide were added to the second portion of emulsion E-1. The resultant mixture was ripened at 61° C. for such a time that the emulsion would have an appropriate sensitivity.

Emulsion E-2 was prepared by the same method as emulsion E-1, except that potassium hexachloroiridate (III) was added in an amount of $5.0\times10^{-7}$ mol per mol of silver, before the second shell was formed. Also, emulsion E-3 was prepared by the same method as emulsion E-1, except that yellow prussiate was added in an amount of $5\times10^{-5}$ mol per mol of silver was added before the second shell was formed. Further, emulsion E-4 was prepared by the same method as emulsion E-1, except that lead acetate was added in an amount of $3\times10^{-6}$ mol per mol of silver before the second shell was formed.

A plurality of layers having the following compositions were coated on an undercoated triacetylcellulose film support, forming a multi-layer color light-sensitive material (hereinafter referred to as "Sample 201").

Compositions of Light-sensitive Layers

Numerals corresponding to each component indicates a coating amount represented in units of g/m$^2$. The coating amount of a silver halide is represented by the coating amount of silver. The coating amount of a sensitizing dye is represented in units of moles per mole of a silver halide in the same layer.

Sample 201

| | |
|---|---|
| **Layer 1: Antihalation layer** | |
| Black colloidal silver | silver 0.18 |
| Gelatin | 1.40 |
| **Layer 2: Interlayer** | |
| 2,5-di-t-pentadecylhydroquinone | 0.18 |
| EX-1 | 0.18 |
| EX-3 | 0.02 |
| EX-12 | $2.0\times10^{-3}$ |
| U-1 | 0.06 |
| U-2 | 0.08 |
| U-3 | 0.10 |
| HBS-1 | 0.10 |
| HBS-2 | 0.02 |
| Gelatin | 1.04 |
| **Layer 3: 1st red-sensitive emulsion layer** | |
| Emulsion A | silver 0.25 |
| Emulsion B | silver 0.25 |
| Sensitizing dye I | $6.9\times10^{-5}$ |
| Sensitizing dye II | $1.8\times10^{-5}$ |
| Sensitizing dye III | $3.1\times10^{-4}$ |
| EX-2 | 0.17 |
| EX-10 | 0.02 |
| EX-14 | 0.17 |
| U-1 | 0.07 |

-continued

| | |
|---|---|
| U-2 | 0.05 |
| U-3 | 0.07 |
| HBS-1 | 0.06 |
| Gelatin | 0.87 |
| Layer 4: 2nd red-sensitive emulsion layer | |
| Emulsion D | silver 0.80 |
| Sensitizing dye I | $3.5 \times 10^{-4}$ |
| Sensitizing dye II | $1.6 \times 10^{-5}$ |
| Sensitizing dye III | $5.1 \times 10^{-4}$ |
| EX-2 | 0.20 |
| EX-3 | 0.05 |
| EX-10 | 0.015 |
| EX-14 | 0.20 |
| EX-15 | 0.05 |
| U-1 | 0.07 |
| U-2 | 0.05 |
| U-3 | 0.07 |
| Gelatin | 1.30 |
| Layer 5: 3rd red-sensitive emulsion layer | |
| Emulsion E-1 (sulfur-sensitized) | silver 1.40 |
| Sensitizing dye I | $2.4 \times 10^{-4}$ |
| Sensitizing dye II | $1.0 \times 10^{-4}$ |
| Sensitizing dye III | $3.4 \times 10^{-4}$ |
| EX-2 | 0.097 |
| EX-3 | 0.01 |
| EX-4 | 0.08 |
| HBS-1 | 0.22 |
| HBS-2 | 0.10 |
| Gelatin | 1.63 |
| Layer 6: Interlayer | |
| EX-5 | 0.04 |
| HBS-1 | 0.02 |
| Gelatin | 0.80 |
| Layer 7: 1st green-sensitive emulsion layer | |
| Emulsion C | silver 0.30 |
| Sensitizing dye IV | $2.6 \times 10^{-5}$ |
| Sensitizing dye V | $1.8 \times 10^{-4}$ |
| Sensitizing dye VI | $6.9 \times 10^{-4}$ |
| EX-1 | 0.021 |
| EX-6 | 0.26 |
| EX-7 | 0.03 |
| EX-8 | 0.025 |
| HBS-1 | 0.10 |
| HBS-3 | 0.01 |
| Gelatin | 0.63 |
| Layer 8: 2nd green-sensitive emulsion layer | |
| Emulsion D | silver 0.55 |
| Sensitizing dye IV | $2.2 \times 10^{-5}$ |
| Sensitizing dye V | $1.5 \times 10^{-4}$ |
| Sensitizing dye VI | $5.8 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Layer 9: 3rd green-sensitive emulsion layer | |
| Emulsion E | silver 1.55 |
| Sensitizing dye IV | $4.6 \times 10^{-5}$ |
| Sensitizing dye V | $1.0 \times 10^{-4}$ |
| Sensitizing dye VI | $3.9 \times 10^{-4}$ |

-continued

| | |
|---|---|
| EX-1 | 0.013 |
| EX-11 | 0.065 |
| EX-13 | 0.019 |
| HBS-1 | 0.25 |
| HBS-2 | 0.10 |
| Gelatin | 1.54 |
| Layer 10: Yellow filter layer | |
| Yellow colloidal silver | silver 0.035 |
| EX-5 | 0.08 |
| HBS-1 | 0.03 |
| Gelatin | 0.95 |
| Layer 11: 1st blue-sensitive emulsion layer | |
| Emulsion C | silver 0.18 |
| Sensitizing dye VII | $8.6 \times 10^{-4}$ |
| EX-8 | 0.042 |
| EX-9 | 0.72 |
| HBS-1 | 0.28 |
| Gelatin | 1.10 |
| Layer 12: 2nd blue-sensitive emulsion layer | |
| Emulsion D | silver 0.40 |
| Sensitizing dye VII | $7.4 \times 10^{-4}$ |
| EX-9 | 0.15 |
| EX-10 | $7.0 \times 10^{-3}$ |
| HBS-1 | 0.05 |
| Gelatin | 0.78 |
| Layer 13: 3rd blue-sensitive emulsion layer | |
| Emulsion F | silver 0.70 |
| Sensitizing dye VII | $2.8 \times 10^{-4}$ |
| EX-9 | 0.20 |
| HBS-1 | 0.07 |
| Gelatin | 0.69 |
| Layer 14: 1st protective layer | |
| Emulsion G | silver 0.20 |
| $U^{-4}$ | 0.11 |
| $U^{-5}$ | 0.17 |
| HBS-1 | $5.0 \times 10^{-2}$ |
| Gelatin | 1.00 |
| Layer 15: 2nd protective layer | |
| H-1 | 0.40 |
| B-1 (diameter: 1.7μ) | $5.0 \times 10^{-2}$ |
| B-2 (diameter: 1.7μ) | 0.10 |
| B-3 | 0.10 |
| S-1 | 0.20 |
| Gelatin | 1.20 |

Further, all layers of Sample 201 contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rohdium salt, so that they could have improved storage stability, could be more readily processed, could be more resistant to pressure, more antibacterial and more antifungal, could be better protected against electrical charging, and could be more readily coated.

The particulars of emulsions A to G used will be shown in Table 2, and the compounds used will be specified by the following formulas.

TABLE 2

| | Average AgI content (%) | Average grain size (μm) | Variation coefficient of grain size (%) | Diameter/ thickness ratio | Silver amount ratio [core/ middle/shell] (AgI content ratio) | Grain structure and shape |
|---|---|---|---|---|---|---|
| Emulsion A | 4.0 | 0.45 | 27 | 1 | [1/3] (13/1) | Double structure, octahedral grain |
| Emulsion B | 8.9 | 0.70 | 14 | 1 | [3/7] (25/2) | Double structure, octahedral grain |
| Emulsion C | 2.0 | 0.55 | 25 | 7 | | Uniform tabular grain |
| Emulsion D | 9.0 | 0.65 | 25 | 6 | [12/59/29] (0/11/8) | Triple structure, tabular grain |
| Emulsion E | 14.5 | 1.25 | 25 | 3 | [37/63] (34/3) | Double structure, tabular grain |
| Emulsion G | 1.0 | 0.07 | 15 | 1 | | Uniform fine grain |

EX-1

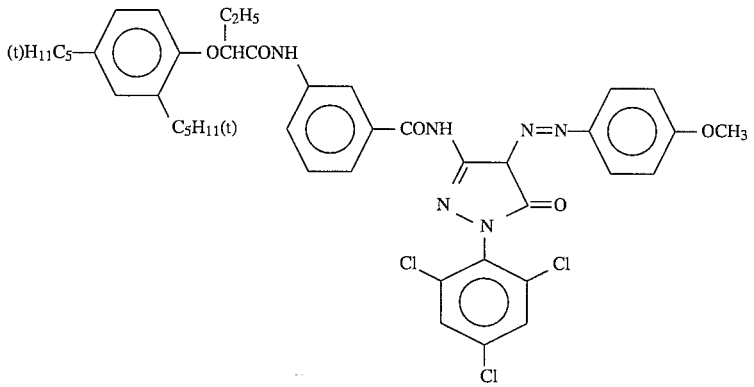

EX-2

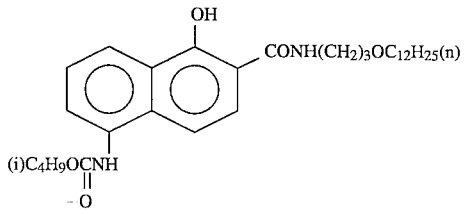

EX-3

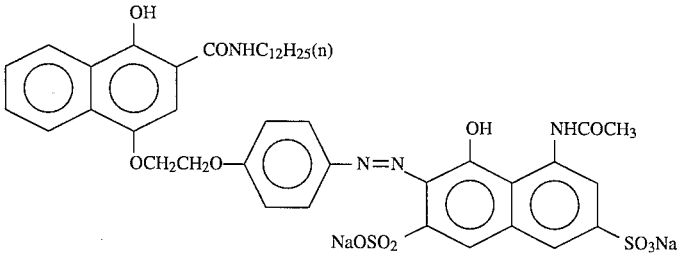

-continued
EX-4
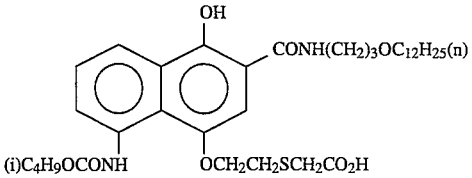
EX-5
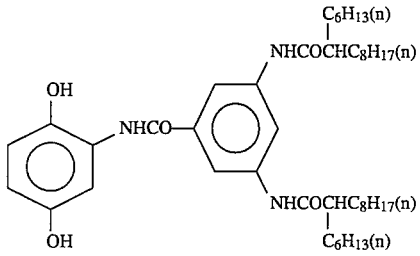
EX-6
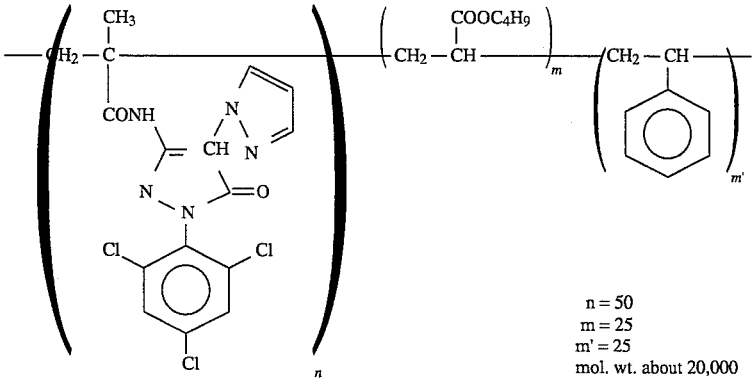
n = 50
m = 25
m' = 25
mol. wt. about 20,000
EX-7
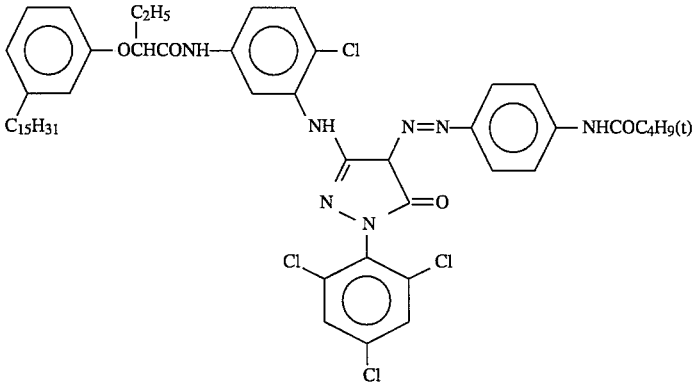
EX-8
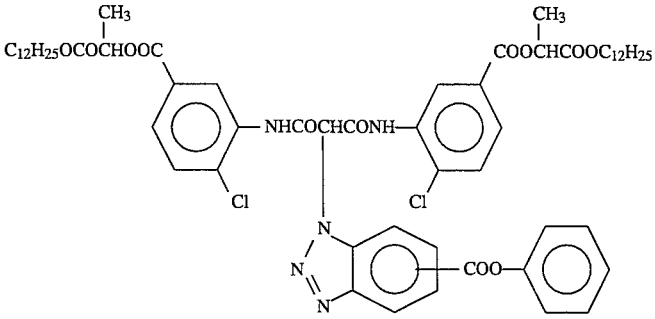

-continued
EX-9
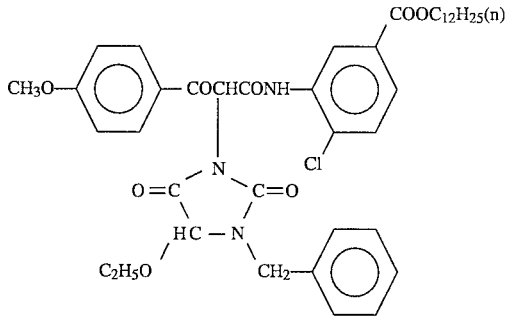
EX-10
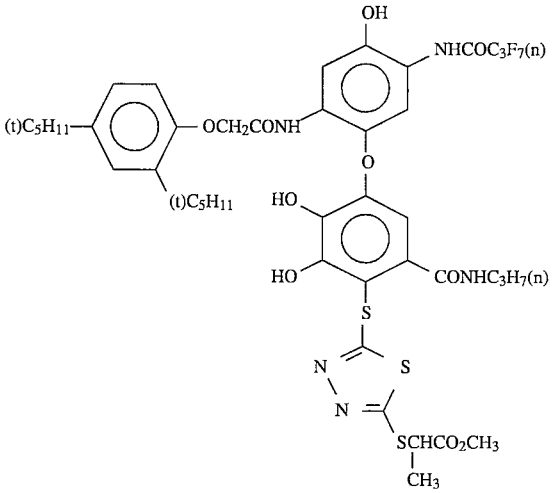
EX-11
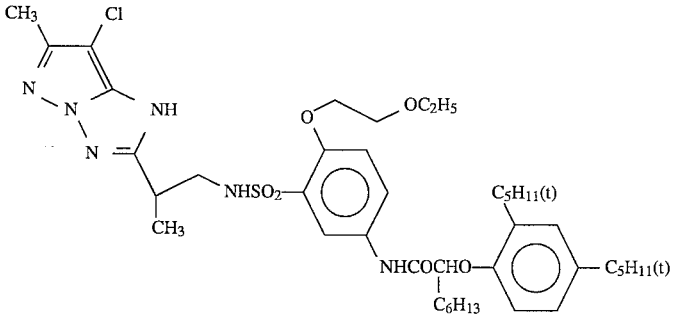
EX-12
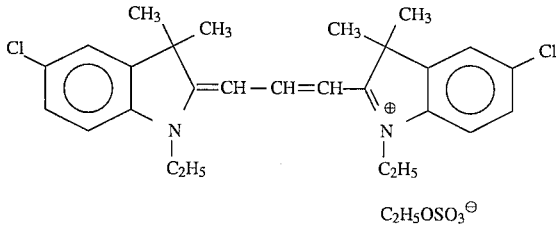

-continued
EX-13
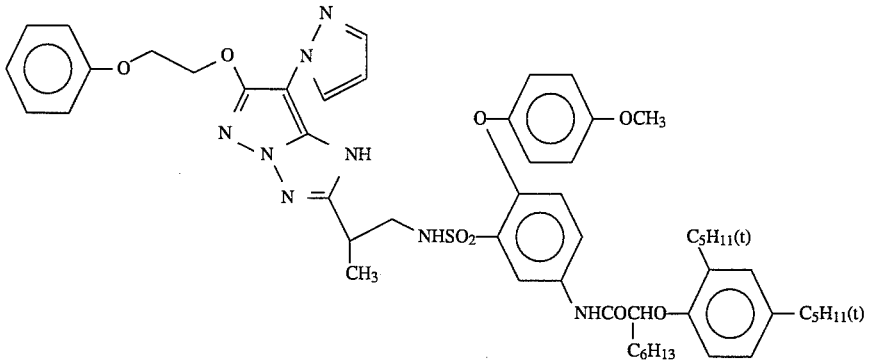
EX-14
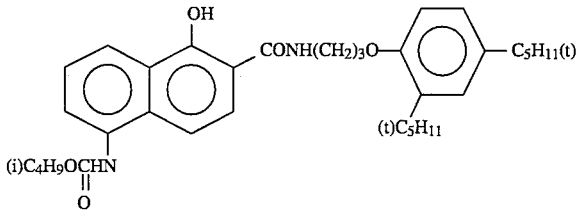
EX-15
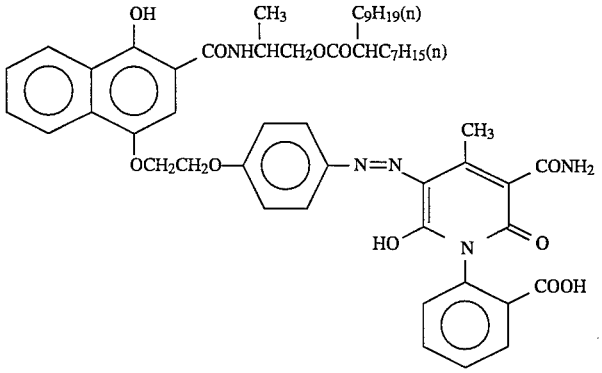
U-1
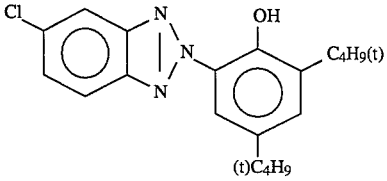
U-2
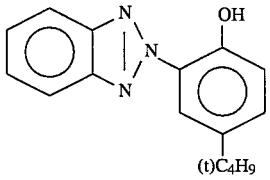
U-3
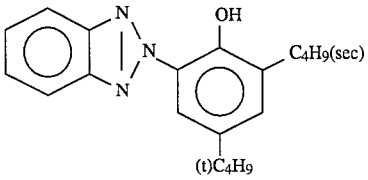
U-4
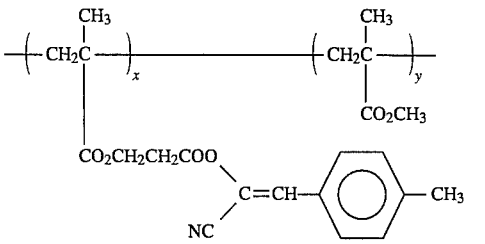
x:y = 70:30 (wt %)
U-5
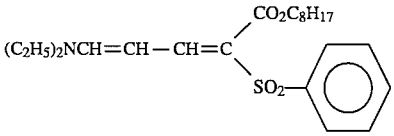

Tricresylphosphate HBS-1
Di-n-butylphthalate HBS-2
HBS-3
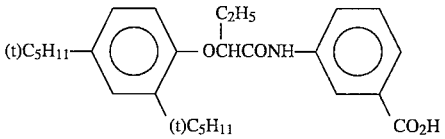
sensitizing dye I
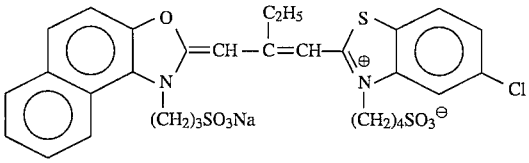
sensitizing dye II
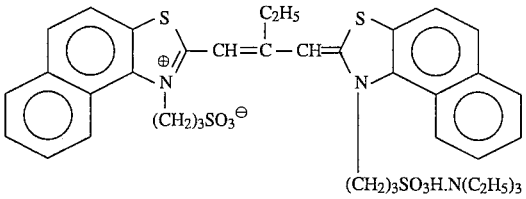
sensitizing dye III
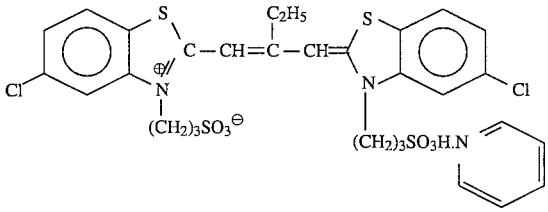
sensitizing dye IV
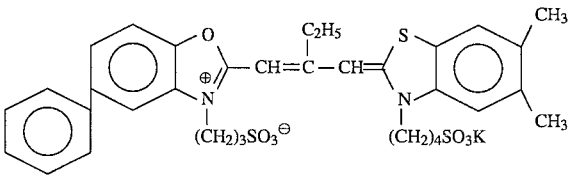
sensitizing dye V
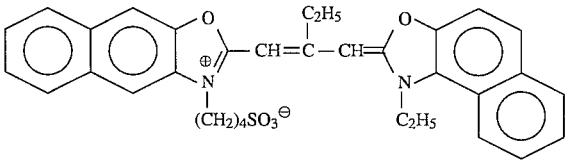
sensitizing dye VI
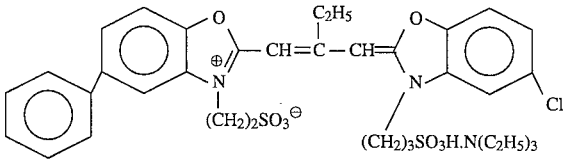
sensitizing dye VII
-continued
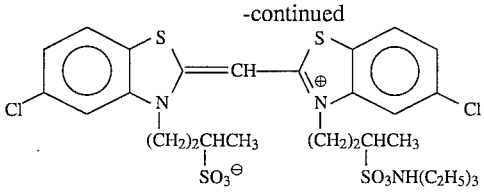
S-1
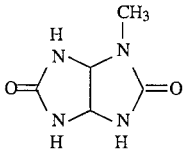
H-1
$CH_2=CH-SO_2-CH_2-CONH-CH_2$
$CH_2=CH-SO_2-CH_2-CONH-CH_2$
B-1
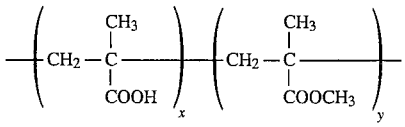
x/y = 10/90
B-2
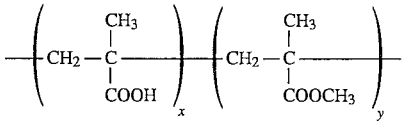
x/y = 40/60
B-3
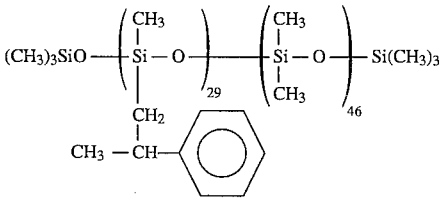
B-4
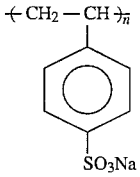
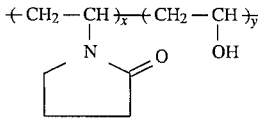
x/y = 70/30B-5
W-1
$C_8H_{17}SO_2NHCH_2CH_2CH_2OCH_2CH_2\overset{\oplus}{N}(CH_3)_3$
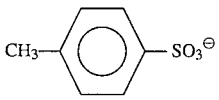
W-2
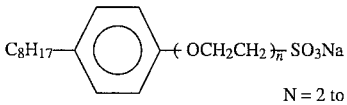
N = 2 to 4

-continued

W-3

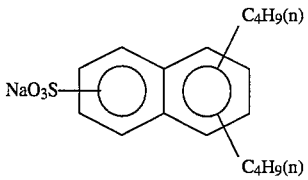

F-1

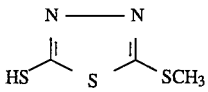

F-2

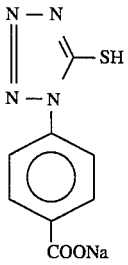

F-3

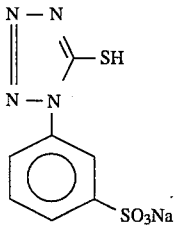

F-4

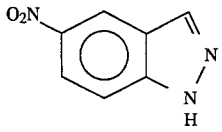

F-5

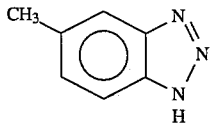

F-6

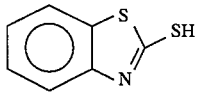

F-7

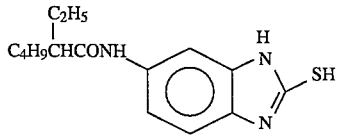

F-8

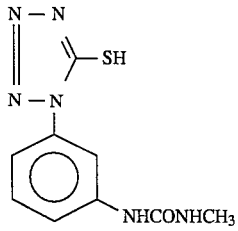

F-9

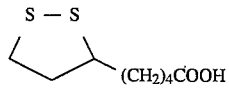

-continued

F-10

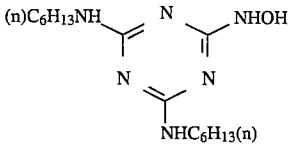

F-11

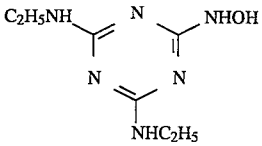

F-12

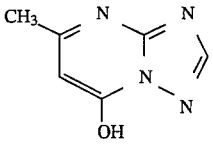

F-13

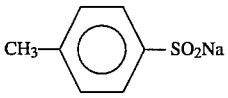

Samples 202 to 208

Sample 202 to 208 were prepared in the same way as Sample 201, except that the emulsions specified in Table 4 (later presented) were contained in the layer 5, replacing emulsion E-1. Samples 202 to 208, thus prepared, and Sample 201 were subjected to white light exposure for 1/100 seconds and also for 100 seconds, were developed by means of an automatic developing machine, and were processed by the method specified in Table 3, until the amount of the replenisher amounted to three times the volume of the mother-solution tank.

TABLE 3

| Processing Method | | | | |
|---|---|---|---|---|
| | | | Replenish Tank | |
| Process | Time | Temp. | Amount* | volume |
| Color development | 3 min. 15 sec. | 38° C. | 33 ml | 20 l |
| Bleaching | 6 min. 30 sec. | 38° C. | 25 ml | 40 l |
| Washing | 2 min. 10 sec. | 24° C. | 1200 ml | 20 l |
| Fixing | 4 min. 20 sec. | 38° C. | 25 ml | 30 l |
| washing (1) | 1 min. 05 sec. | 24° C. | * * | 10 l |
| washing (2) | 1 min. 00 sec. | 24° C. | 1200 ml | 10 l |
| Stabilization | 1 min. 05 sec. | 38° C. | 25 ml | 10 l |
| Drying | 4 min. 20 sec. | 55° C. | | |

*Replenishing amount per meter of a 35-mm wide sample
**Counter flow from the step (2) to the step (1)

** Counter flow from the step (2) to the step (1)

The compositions of the solutions used in the color-developing process are as follows:

| | Mother Solution (g) | Replenisher (g) |
|---|---|---|
| 1) Color Developing Solution | | |
| Diethylenetriamine-pentaacetate | 1.0 | 1.1 |
| 1-hydroxyethylidene-1,1-diphosphonic acid | 3.0 | 3.2 |

-continued

| | Mother Solution (g) | Replenisher (g) |
|---|---|---|
| Sodium sulfide | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxylethylamino]-2-methylaniline sulfate | 4.5 | 5.5 |
| Water to make | 1.0 l | 1.0 l |
| pH | 10.05 | 10.10 |
| 2) Bleaching Solution | | |
| Sodium ethylenediamine tetraacetatoferrate trihydrate | 100.0 | 120.0 |
| Disodium ethylenediamine tetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| Water to make | 1.0 l | 1.0 l |
| pH | 6.0 | 5.7 |
| 3) Fixing Solution | | |
| Disodium ethylene diamine tetra-aacete | 0.5 | 0.7 |
| Sodium sulfite | 7.0 | 8.0 |
| Sodium bisulfite | 5.0 | 5.5 |
| Aqueous Ammonium thiosulfate solution (70%) | 170.0 ml | 200.0 ml |
| Water to make | 1.0 l | 1.0 l |
| pH | 6.7 | 6.6 |
| 4) Stabilizing Solution | | |
| Formalin (37%) | 2.0 ml | 3.0 ml |
| Polyoxyethylene-p-monononyl phenyl ether (Average polymerization degree: 10) | 0.3 | 0.45 |
| Disodium ethylenediamine tetra-acetate | 0.05 | 0.08 |
| Water to make | 1.0 l | 1.0 l |
| pH | 5.0 to 8.0 | 5.0 to 8.0 |

The photographic properties of Samples 201 to 208 were evaluated, and the results were as is shown in the following Table 4:

TABLE 4

| Sample | Emulsion | Chemical Sensitization | Fogging | 1/100" Exposure Sensitivity/ Gradation | 100" Exposure Sensitivity |
|---|---|---|---|---|---|
| 201 | E-1 | Sulfur sensatization | 0.10 | 100/0.65 | 25 |
| 202 | E-1 | Tellurium sensitization | 0.15 | 110/0.62 | 23 |
| 203 | E-2 | Sulfur sensitization | 0.11 | 90/0.64 | 60 |
| 204 | E-2 | Tellurium sensitization | 0.14 | 112/0.66 | 68 |
| 205 | E-3 | Sulfur sensitization | 0.14 | 95/0.69 | * |
| 206 | E-3 | Tellurium sensitization | 0.13 | 112/0.69 | * |
| 207 | E-4 | Sulfur sensitization | 0.09 | 85/0.70 | * |
| 208 | E-4 | Tellurium sensitization | 0.11 | 105/0.72 | * |

*Not evaluated

As can be understood from Table 4, a sulfur-sensitized emulsion containing iridium compound improves the low-illuminance reciprocity very much, but lowered the sensitivity the sample has when exposed to light for 1/100 seconds. By contrast, a tellurium-sensitized emulsion containing iridium improved the reciprocity low failure at low, with no detriment to the sensitivity the sample had when exposed to light for 1/100 seconds.

As is evident from Table 4, yellow prussiate or lead compound serves to improve the gradation of the sample, but reduces the sensitivity the sample has when exposed to light for 1/100 seconds. By contrast, a tellurium-sensitized emulsion containing yellow prussiate or lead compound can increase the gradation of the sample, with no detriment to the sensitivity the sample has when exposed to light for 1/100 seconds. The same photographic effects can be find in emulsion A for the layer 3, emulsion D for the layer 8, and emulsion F for the layer 13.

As has been described, the present invention can provide a silver halide photographic light-sensitive material which has its photographic properties, particularly the gradation and the reciprocity, improved, with no reduction of its sensitivity.

What is claimed is:

1. A silver halide photographic light-sensitive material comprising at least one layer of a silver halide emulsion comprising a dispersion medium and silver halide grains dispersed in the dispersion medium, each of said silver halide grains containing metal ions other than silver ions, and said emulsion having been chemically sensitized with at least one tellurium sensitizer represented by the following formula (IIA):

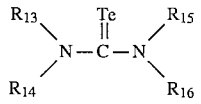

(IIA)

where $R_{13}$ and $R_{15}$ combine with each other to form a divalent group selected from the group consisting of alkylene, alkenylene, aralkylene and arylene, said divalent group forming a ring together with N—C—N; and each of $R_{14}$ and $R_{16}$ represents an alkyl group or an aromatic group.

2. A silver halide photographic light-sensitive material comprising at least one layer of a silver halide emulsion comprising a dispersion medium and silver halide grains dispersed in the dispersion medium, each of said silver halide grains containing metal ions other than silver ions, and said emulsion having been chemically sensitized with at least one tellurium sensitizer represented by the following formula (IIB):

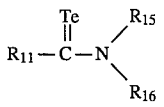

(IIB)

where $R_{11}$ and $R_{15}$ each represent an aliphatic group or an aromatic group, or $R_{11}$ and $R_{15}$ combine with each other to form a ring together with C—N; and $R_{16}$ represents an aliphatic group or an aromatic group.

3. A silver halide photographic light-sensitive material comprising at least one layer of a silver halide emulsion comprising a dispersion medium and silver halide grains dispersed in the dispersion medium, each of said silver halide grains containing metal ions other than silver ions, and said emulsion having been chemically sensitized with at least one tellurium sensitizer represented by the following formula (I):

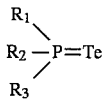

(I)

where each of $R_1$, $R_2$ and $R_3$ represents an aliphatic group, an aromatic group, a heterocyclic group, $OR_4$, $NR_5(R_6)$, $SR_7$, $OSiR_8(R_9)(R_{10})$, a halogen atom or a hydrogen atom; each of $R_4$ and $R_7$ represents an aliphatic group, an aromatic group, a heterocyclic group, a hydrogen atom or a cation; each of $R_5$ and $R_6$ represents an aliphatic group, an aromatic group, a heterocyclic group or a hydrogen atom; and each of $R_8$, $R_9$ and $R_{10}$ represents an aliphatic group; wherein $R_1$ and $R_2$, $R_2$ and $R_3$, or $R_1$ and $R_3$ may combine together to form a ring.

4. The light-sensitive material according to claim 1, 2 or 3, wherein said silver halide grains contain polyvalent metal ions.

5. The light-sensitive material according to claim 1, 2 or 3, wherein said silver halide emulsion is a mono-dispersed emulsion having a variation coefficient of 22% or less.

6. The light-sensitive material according to claim 1, 2 or 3, wherein said metal ions comprise those of at least one Group VIII metal selected from the group consisting of Ir, Rh, Pd, Ru, Pt and Os.

7. The light-sensitive material according to claim 1, 2 or 3, wherein said metal ions comprise those of at least one Group VIII transition metal selected from the group consisting of Fe, Ni and Co.

8. The light-sensitive material according to claim 1, 2 or 3, wherein said metal ions comprise those of at least one bivalent metal selected from the group consisting of Pd and Cd.

9. The light-sensitive material according to claim 1, 2 or 3, wherein said metal ions are contained in an amount of $10^{-9}$ mol to $10^{-3}$ mol per mol of silver halide in said silver halide grains.

10. The light-sensitive material according to claim 1, 2 or 3, wherein said metal ions are contained in an amount of $10^{-8}$ mol to $10^{-4}$ mol per mol of silver halide in said silver halide grains.

11. The light-sensitive material according to claim 1, 2, or 3, wherein said emulsion is chemically sensitized by means of tellurium sensitization and sulfur sensitization.

12. The light-sensitive material according to claim 1, 2, or 3 ,wherein said emulsion is chemically sensitized by means of tellurium sensitization and gold sensitization.

13. The light-sensitive material according to claim 1, 2, or 3, wherein said emulsion is chemically sensitized by means of tellurium sensitization, sulfur sensitization, and gold sensitization.

14. The light-sensitive material according to claim 1, 2, or 3, wherein said emulsion is a silver chlorobromide emulsion.

15. The light-sensitive material according to claim 1, 2, or 3, wherein said emulsion contains tabular grains having an aspect ratio of at least 2 and less than 20.

* * * * *

UNITED STATES PATENT AND TRADEMARK OFFICE

CERTIFICATE OF CORRECTION

PATENT NO. : 5,459,027
DATED : October 17, 1995
INVENTOR(S) : Takada et al.

It is certified that error appears in the above-indentified patent and that said Letters Patent is hereby corrected as shown below:

ON THE TITLE PAGE:

Item "[*] Notice:" change "June 1, 2010" to --May 20, 2011--

Signed and Sealed this

Twelfth Day of May, 1998

*Attest:*

*Attesting Officer*

BRUCE LEHMAN

*Commissioner of Patents and Trademarks*